US006321860B1

(12) United States Patent
Reddoch

(10) Patent No.: US 6,321,860 B1
(45) Date of Patent: Nov. 27, 2001

(54) CUTTINGS INJECTION SYSTEM AND METHOD

(76) Inventor: Jeffrey Reddoch, P.O. Box 82098, Lafayette, LA (US) 70598-2098

( * ) Notice: Subject to any disclaimer, the term of this patent is extended or adjusted under 35 U.S.C. 154(b) by 0 days.

(21) Appl. No.: 09/461,604

(22) Filed: Jan. 20, 1998

Related U.S. Application Data

(63) Continuation-in-part of application No. 08/896,205, filed on Jul. 17, 1997, now abandoned.

(51) Int. Cl.[7] ..... E21B 21/00
(52) U.S. Cl. ..... 175/206; 175/207; 405/128
(58) Field of Search ..... 17/66, 206, 207; 166/335; 405/128

(56) References Cited

U.S. PATENT DOCUMENTS

| | | | | |
|---|---|---|---|---|
| 4,595,422 | | 6/1986 | Hill et al. . | |
| 4,632,188 | * | 12/1986 | Schuh et al. | 166/368 |
| 4,942,929 | | 7/1990 | Malachosky et al. . | |
| 5,085,277 | * | 2/1992 | Hopper | 166/335 |
| 5,109,933 | | 5/1992 | Jackson . | |
| 5,129,468 | | 7/1992 | Parmenter . | |
| 5,129,469 | | 7/1992 | Jackson . | |
| 5,303,786 | | 4/1994 | Prestridge et al. . | |
| 5,361,998 | | 11/1994 | Sirevag et al. . | |
| 5,400,977 | * | 3/1995 | Hayles | 241/154 |
| 5,431,236 | | 7/1995 | Warren . | |

* cited by examiner

*Primary Examiner*—Roger Schoeppel
(74) *Attorney, Agent, or Firm*—Robert N. Montgomery

(57) ABSTRACT

An automated high speed drill cuttings processing and injection module having a relatively small foot print, capable of operation in zone 1 hazardous environments, for injecting drill cuttings into an earth formation. Capable of handling high drilling rate cuttings surges. The process including conveying systems, holding and slurry tanks, circulating pumps, high speed grinding mill, high pressure injection pump, fragmentation system and automation system for controlling electrically driven injection pump having automatic speed control regulation with torque and horsepower limiting features. Thereby allowing high speed injection without plugging the formation while still allow for high pressure formation fracturing when necessary. The processing system further insures cuttings slurry homogenization and entrained particle size to less than 100 micron for both hard and soft particles. Being unitized the system reduces installation cost dramatically. The system further provides continuous automatic control, measures and records hole cleaning, viscosity, slurry density, as well as surface and bottom-hole pressure.

36 Claims, 12 Drawing Sheets

CUTTINGS INJECTION SYSTEM AND METHOD

This application is a continuation-in-part of application Ser. No. 08/896,205, filed Jul. 17, 1997, now abandoned.

BACKGROUND OF THE INVENTION

1. Field of the Invention

This invention relates to the collection and processing of drill cuttings separated from a drilling rig's solids control system and more particular to the processing and injections of such cuttings into fractures in the earth formation adjacent the well being drilled via the annulus between a well casing and well bore or into other such cuttings disposal scenarios.

2. General Background

In the oil and gas drilling industry the processing of drill cuttings and their disposal has been a logistics and environmental problem for a number of years. Various systems have been developed for handling and processing the cuttings for disposal and reclamation. Such systems include returning the cuttings via injection under high pressure back into the earth formation in a manner such as that described in U.S. Pat. Nos. 4,942,929, 5,129,469 and 5,109,933, and the treatment of drill cuttings as disclosed by U.S. Pat. Nos. 4,595,422 5,129,468, 5,361,998 and 5,303,786. However, in practice, the injection process is not as simple as it may seem. The preparation of the cuttings into a homogeneous mix which is acceptable to high pressure pumps used in pumping material down a well is essential. Transforming the cuttings into a pumpable slurry is complicated by variable drill rates producing large volumes of cuttings at times thereby creating surges in drill waste materials, the need to pump the slurry at high pressures into the earth and/or formation fractures hundreds if not thousands of feet below the surface. Complications also arise due to the need for constant velocity and high horsepower while pumping. On offshore platforms space is at a premium. Therefore, cuttings treatment units must be compact and as light in weight as possible. Solids control equipment is most often placed in hazardous areas, near the well bore, where large horsepower internal combustion engines are not permitted due to the possibility of high gas concentration. Therefore, any additional equipment used for processing solids must meet stringent explosion proof requirements for such areas of the rig.

Heretofore, cuttings injection has not gained wide acceptance in offshore drilling operations such as may be found in the North Sea, primarily due to the problems discussed above and the inefficiency and ineffectiveness of the cuttings preparation and injection processes.

Although, other cuttings processing system have been developed for preparing drill cutting for disposal and some have been tried in an attempt to inject such processed drill cuttings into a well bore, as is disclosed by U.S. Pat. Nos. 4,942,929, 5,129,469, and 5,109,933 and 5,431,236. However, none combine, individually or collectively all of the advanced features, required for problem-free cuttings injection, disclosed herein by the instant invention.

The problems associated with cuttings injection are numerous as expressed by Warren in U.S. Pat. No. 5,431,236. Starting with processing of the cuttings for injection, we find that the particles are not uniform in size and density making the slurification process very complicated. The cuttings mixture often plugs circulating pumps, the abrasiveness of the cuttings also abrade the pump impellers causing cracking, some attempts have been made to use the circulating pumps for grinding the injection particles by purposely causing pump cavitaion, thereby shortening pump life, hard cakes build up in tanks creating circulation problems and circulation pumps cavitate unexpectedly due to irregular particle size. Therefore, it is known that a uniform particle size of less than 100 micron must be maintained for proper formation injection at the well site. Maintaining such consistency with hard and soft materials is very difficult. The use of shear guns to reduce particle size as taught by Warren does not insure consistency and requires continuous recalibration thereby reducing the volume capacity of the processor. Warren also teaches that sand should be separated through the use of hydrocyclones which further reduces throughput volume.

Next we find that since no two earth formations are alike it is very difficult to prevent plugging of the formation fractures in the well bore especially when there are long delays in placement of the injection slurry in the formation. Plugging of the formation fractures often occurs as a direct result of large particle size, often in the range of 300 micron or greater, combined with high pressure high volume applications. Plugging of the well formation results in extensive well drilling downtime which is very expensive.

Cuttings injection failures have occurred primarily due to the inability to, handle large volumes of cuttings surges, fine tune the injection process by providing particle size control, uniform slurry density and to provide volume and pressure control over the injection process. Further, attempts to inject cutting slurries into the earth have met with failure as a result of the inability to manually control all facets of the process and injection operation. As a result of such failures most offshore drilling operators in the North Sea have ban the practice and have resorted to using expensive synthetic drill fluids.

It is to this end that the present invention has been developed, the proprietary know-how of which has been maintained until disclosed herein thereby, disclosing a unique efficient system and method for injecting drill cuttings into an offshore oil and gas well in a drilling environment requiring compactness, relatively light weight, low maintenance, full automation and operability in hazardous potentially explosive environments.

SUMMARY OF THE INVENTION

The instant invention has overcome the problems of the prior art and has proven itself by successfully performing cuttings processing and injection in wells where others have failed under identical conditions. The instant invention relates to a drill cuttings processing and injection system for use in hazardous oil and gas well drilling environments where compactness, smooth high performance injection pumping which provides zero downtime and volume variability, and where reduced maintenance are essential. In accordance, a modular processing system is provided comprising a shaker package, a grinder and/or roll mill package, a slurrification control package, Slurrification tanks, transfer pump package, injection pump package, air control system , hydraulics package, and Electrical package. The self-contained system transfers drill cuttings from the drilling rig's cuttings shaker discharge trough to the system slurrification package where the cuttings are further processed for injection, via a high pressure pump, deep into the earth's formation. These and other aspects of the present invention together with certain advantages and superior features thereof may be further appreciated by those skilled in the art upon reading the following detailed description.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
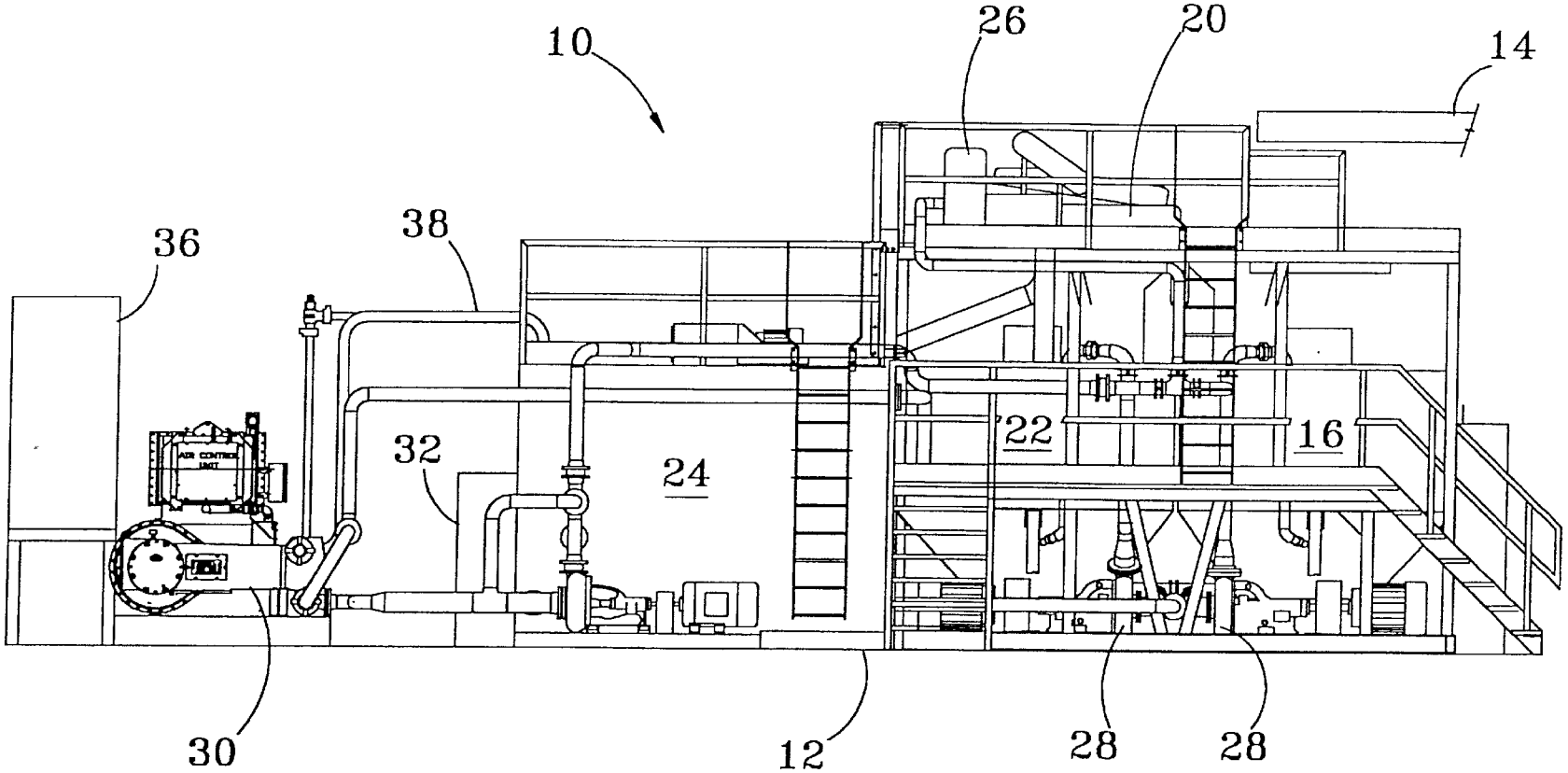
FIG. 1 is a side elevation of the process module.
Figure 2:
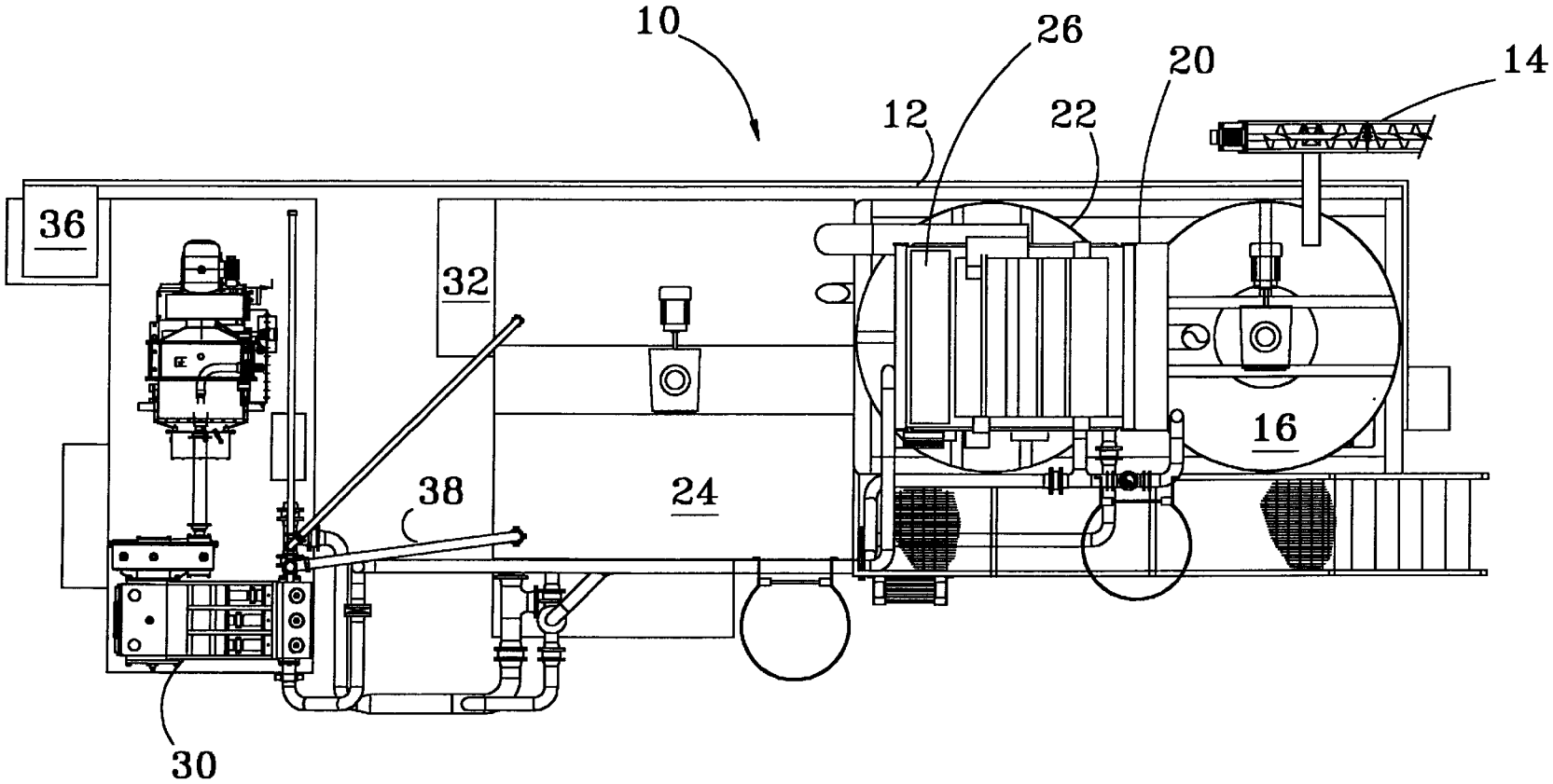
FIG. 2 is top view of the process module.
Figure 3:
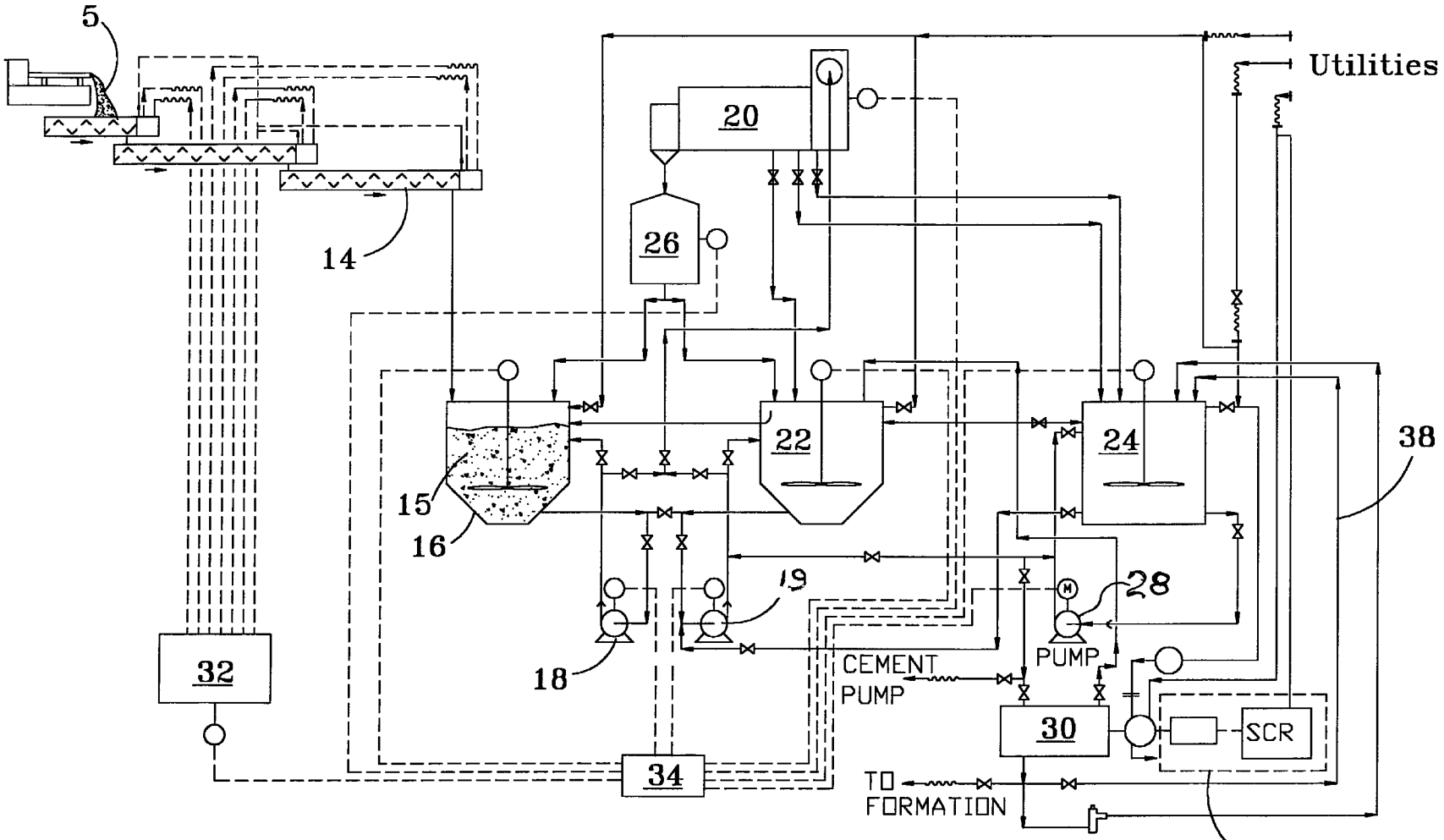
FIG. 3 is schematic diagram of the process system.
Figure 5:
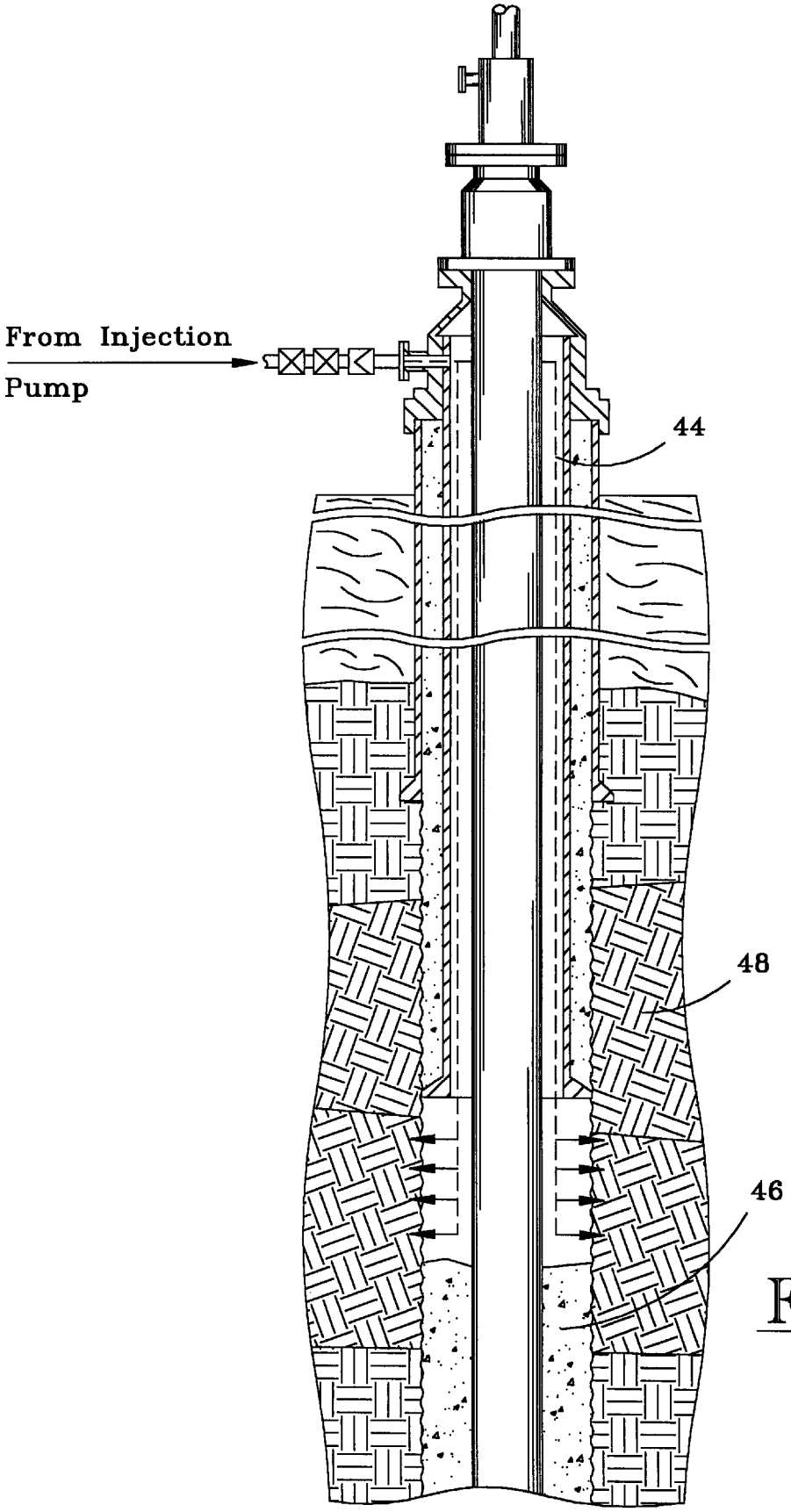
FIG. 5 is a cross section view of the flow path of the cutting slurry into the earth formation via a well bore annulus.

Turning first to FIG. 1 and FIG. 2 we see the invention 10 comprises a processing module 12 which, when assembled, is self contained and fully operational for operation on an offshore drilling location. The Module 12 system as best seen in FIG. 3 further comprises an in-feed cuttings conveyor 14 or other such means which feed overflow drill cuttings 5 from a drilling rig's drilling fluid mud recovery system's shell shakers to the process module 12 where the cuttings 5 are deposited into a first slurry tank 16. The tanks are configured with special baffles and a conical lower portion to prevent plugging and caking of the solids and increase the speed in which the cuttings in a slurry are feed to the grinder pumps 18,19. The cuttings slurry 15 is agitated and ground by the centrifugal shredding or the grinding pumps 18, 19 located adjacent the slurry tank 16 where water is added as necessary to provide a pumpable slurry solution. The slurry 15 is then pumped via either of the two grinding pumps 18,19 to a system shale shaker 20 where the slurry 15 passing through the shale shaker's screens is fed to a second slurry tank 22, where it is further agitated and mixed, or to a holding tank 24. Overflow entrained cuttings which do not pass through the shale shaker's 20 screens is gravity fed to a roll mill 26 where the oversize cuttings 5 such as sand, limestone and shale are instantaneously ground into fine particles and fed back to the first and second slurry tanks 16,22. This high speed milling operation performed by roll mill 26 serves to significantly reduce particle size to a uniform consistence, thus reducing the possibility of restricted flow rates caused by irregular size particles entrained in the slurry during the cutting's 15 first pass through the slurry tanks 16,22. A third pump 28 is provided for recirculating slurry 15 between the holding tank 24 and the two slurry tanks 16,22. The second circulating pump 19 also serves as backup for the first grinding pump 18 thus allowing either of the slurry tanks 16,22 to be the primary tank. Pumps 18 and 19 are fitted with special oversize impellers having large tungsten carbide particle impregnated matrix coatings to prevent cracking and wear. These large impellers shred the cuttings 5 in a manner whereby the softer cuttings are degraded and become entrained in the slurry immediately. Cavitation of the pumps 18,19 is purposely avoided thus reducing wear and cracking of impeller blades. Connection lines are provided for feeding the homogenous slurry, resulting from thorough mixing and slurry particle reduction, to a high pressure injection pump 30 for injection into the annulus 44 of a well bore 46 and ultimately into the earth formation 48 as seen in FIG. 5 or to cement pumping operations if needed. A hydraulics package 32 is provide for driving conveyor motors and an electrical control package 34 is provided for operations of all AC operated equipment. i.e. agitation motors, pump motors, sensors, etc.

A special electrical AC/DC "Speed Control Regulator" (SCR) package 36 is provided for controlling the large, electrical motor driving the high pressure triplex or piston type injector pump 30. This type of motor control has been widely used for industrial plant systems for many years. However, SCR systems have not been employed in the offshore oil and gas industry for drill cuttings 5 injection use in Hazardous locations. It has been found that due to its complexity, its maximum horsepower and speed limitations and its ability to meet class 1 zone 1 hazardous location requirements SCR drives are ideal for such applications. Such zone classifications are used in the industry to designate potentially hazardous gas locations which could become flammable. Hazardous locations are generally limited to equipment having heavy gas-tight enclosures for all electrical apparatus. Therefore, in this case zone 1 on an oil or gas well drilling platform is considered more hazardous than zone two due to its closer proximity to the well head (generally within 50 feet) would require a much higher safety factor with regard to the equipment's probability of causing sparks which could ignite gases emitted from the well.

Problems with such drives in the past have more recently been overcome with the more common use of solid-state circuitry and computer logic systems making such systems less complicated and maintenance free. The SCR system 36 is ideally suited to this particular operation due to its ability to control a wide range of motor speeds, adjustable torque control, excellent speed regulation, dynamic braking, fast, stable response to changing load conditions encountered in deep well pumping operations, horsepower limiting, pressure limiting on well cuttings injection, high efficiency and automatic operation.

A very high horsepower drive, in the 1000 horsepower range, is required for driving the high volume injection pump 30. The injection pump 30 has a discharge pressure of up to 15000 PSI. Several types of injection pumps may be used including triplex and large displacement piston pumps. The prior art usually utilizes a large direct drive diesel engine located in zone 2 (semi-hazardous area) or an inefficient hydraulic drive motor powered by a remote engine or an explosion proof electric motor and pump package as a drive means approved for location in zone 1 areas. However, hydraulic drives have proven to be incapable of controlling high pressure injection pumps of this magnitude (over 200 horsepower) in a satisfactory manner. Primarily due to their high maintenance, heat, inefficiency and noise levels. Noise levels being restricted to 80 decibels or less on offshore drilling rigs in the North Sea increases the difficulty of their use.

The instant invention utilizes a direct coupled electric motor drive for the injection pump 30 controlled by the Speed Control Regulation system 36. The Speed Control Regulation (SCR) system 36 allows an explosion proof motor to be close coupled to a high pressure injection pump. The SCR system is then controlled electrically by a programmed computer system. Thereby providing small foot print, light weight, constant or variable horsepower and torque at selected operating speeds thus reducing surging and stalling of the cuttings injection pump process. There are several methods which may be used to provide speed control for drive motors coupled to the triplex injection pump. For example an engine driving a DC generator which in turn drives a DC driving motor having speed control capability. A second options may be the use of an AC motor driving the DC generator, an AC frequency controlled motor drive, or an AC motor with SCR capability. In any case the advantages of an electric speed controlled drive system far exceeds that of a hydraulic pump and motor drive.

Automated electrical speed control and pressure controls allow other control systems to be implemented which are computerized to assist in automating and controlling the injection process system. Therefore, it is possible to fully automate the process based on formation reaction information. Such a system has many advantages, for example, automation of the system's injector pump speed and torque also prevents formation plugging and is interlocked to protect the well from over pressurization. The systems may also be run at very low speed and low pressure thereby preventing large formation fractures. However, when the need arises high pressure and high horsepower can be applied to fracture the formation.

It is also important to have the ability to leave the slurry in the formation for long periods without plugging the formation or the casing annulus. Therefore, a process has been developed and included into the system for automatically injecting premixed gels having yield strength and fluid loss properties into the slurry solution thereby allowing for formation sensitivity. Such automatic injection may be programmed to a predetermined rate based on formation requirements or to meet real time changing conditions.

Automation further allows computer control of multiple processes thereby drastically reducing or eliminating the need for excessive manning of the system on a constant basis, thus reducing cost of operation.

It is highly desirable to reduce the entrained particle size to less than 100 micron in order to insure long term success of cuttings injection and significantly increase the cuttings volume a well will receive. The smaller the particles size the less plugging and fracturing occurs in the earth formation. Therefore, an important feature of the injection process module 12 is its ability to size and fragment cuttings particles suspended in the slurry 15 at high speed and pressure and thereby preventing constipation of the drill cuttings 5 processing system. This feature prevents shutdowns of drilling operations due to cuttings out flow plugging. One aspect of this high speed process includes an impingement system whereby a line 38 is connected to the discharge line of the injection pump 30 is routed to the holding tank where it is divided into two nozzles 40 which are directed onto heavy plates 42. When necessary this line 38 may be charged at high pressure, thus directing discharge flow from the injection pump 30 directly into the holding tank 24 via said nozzles 40. The entrained cuttings then strike the heavy plates 42 at high velocity thus fragmenting such particles making the slurry even more homogeneous. This system further serves to hydrate the introduced gel chemicals and enhance the fluidity of the drill cuttings 5 thus aiding in slurry preparation and to provide cuttings slurry 15 quality control.

Figure 4:
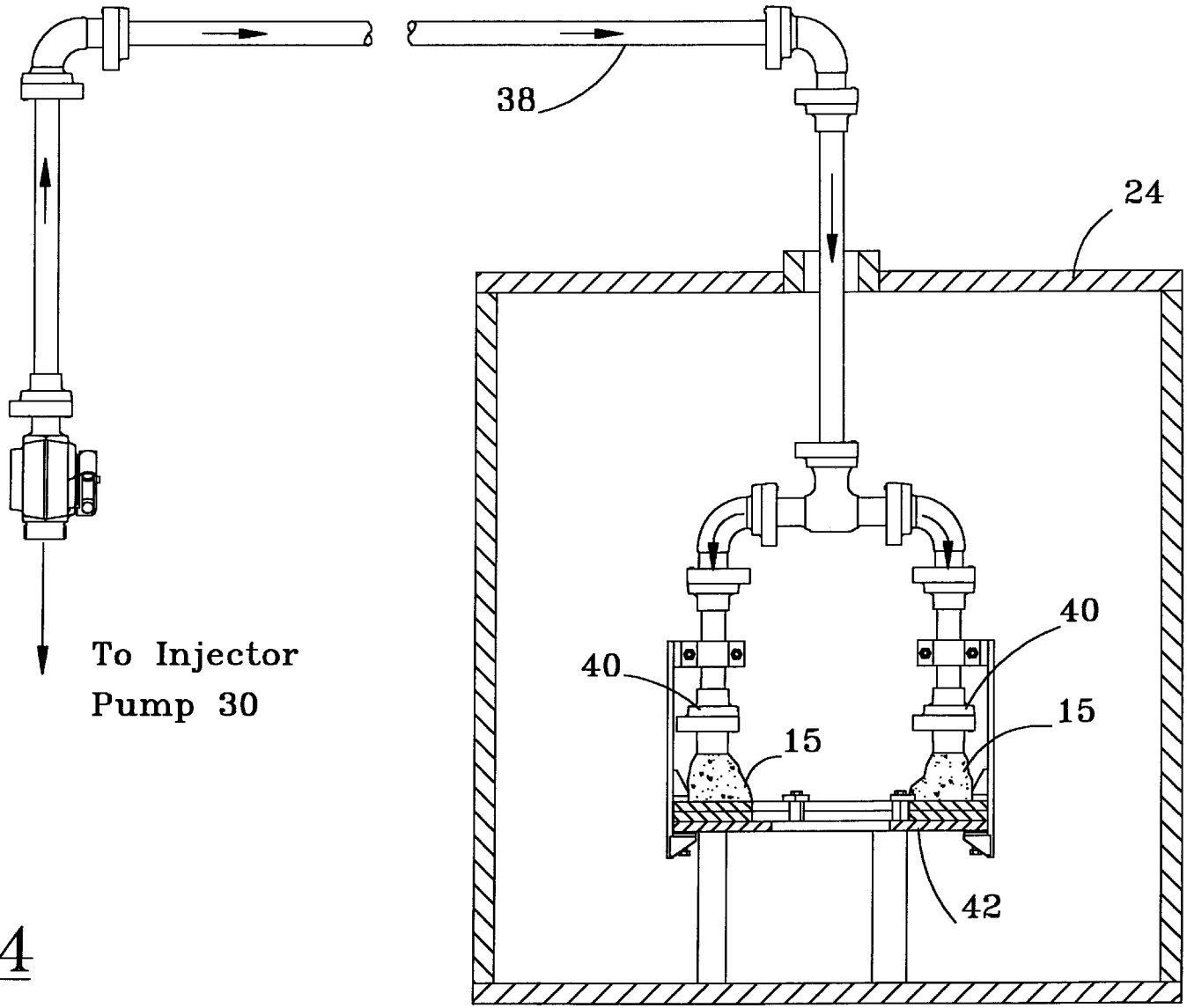
FIG. 4 is a cross section view of the holding tank particle fragmentation system.
Figure 6:
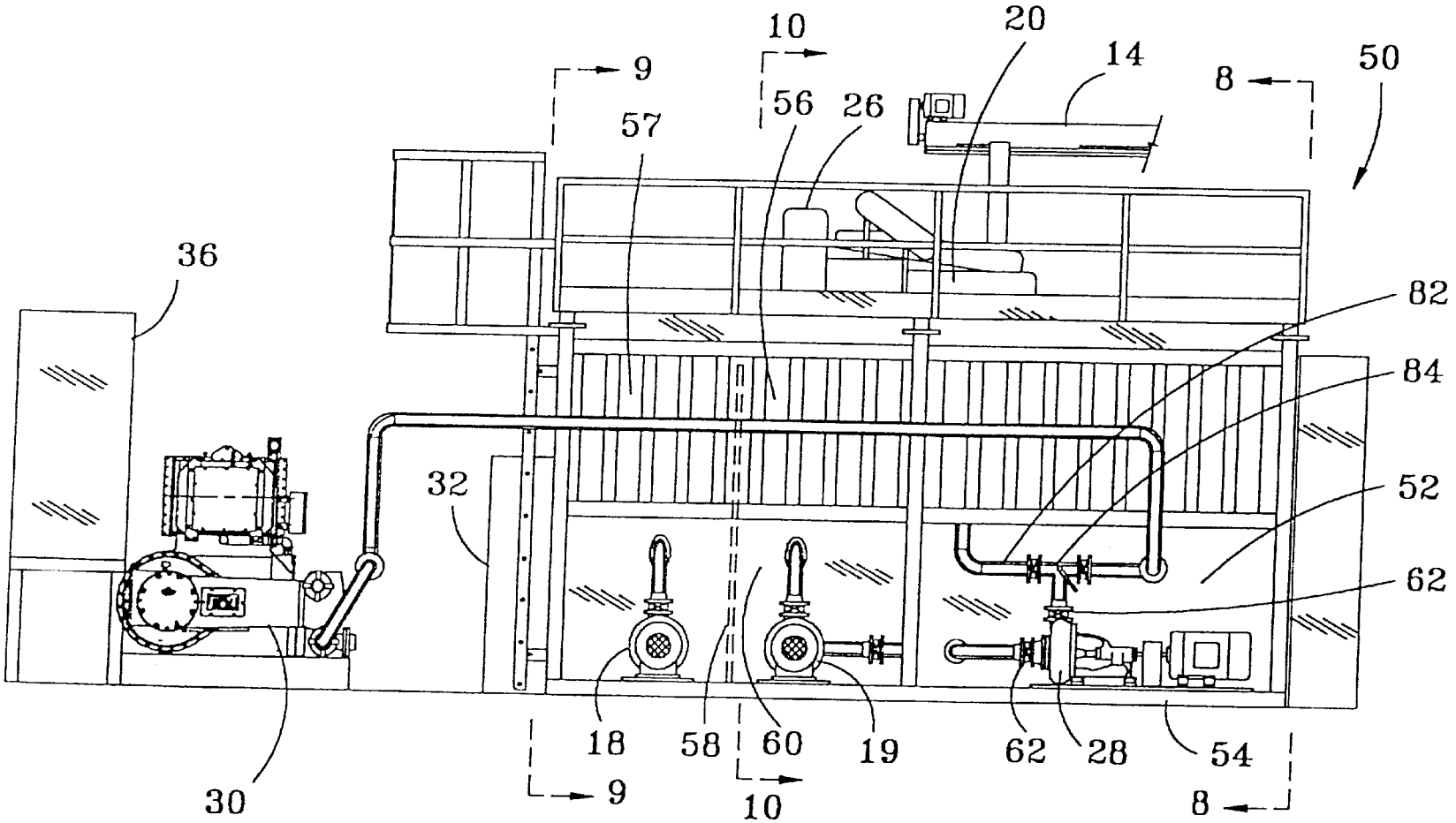
FIG. 6 is a front elevation of a second embodiment of the cuttings and injection module.
Figure 7:
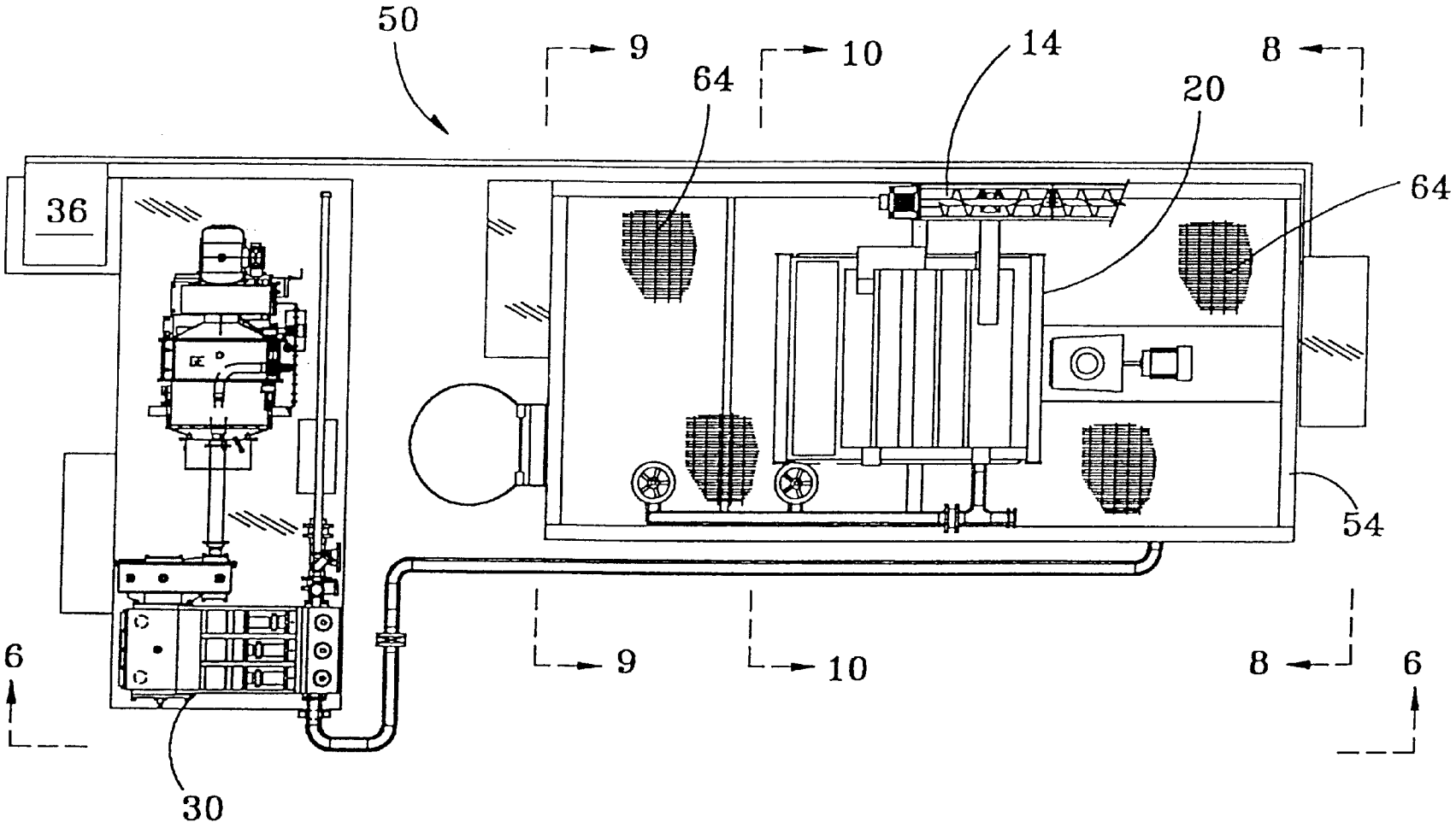
FIG. 7 is a top view of the second embodiment illustrated in FIG. 6.
Figure 8:
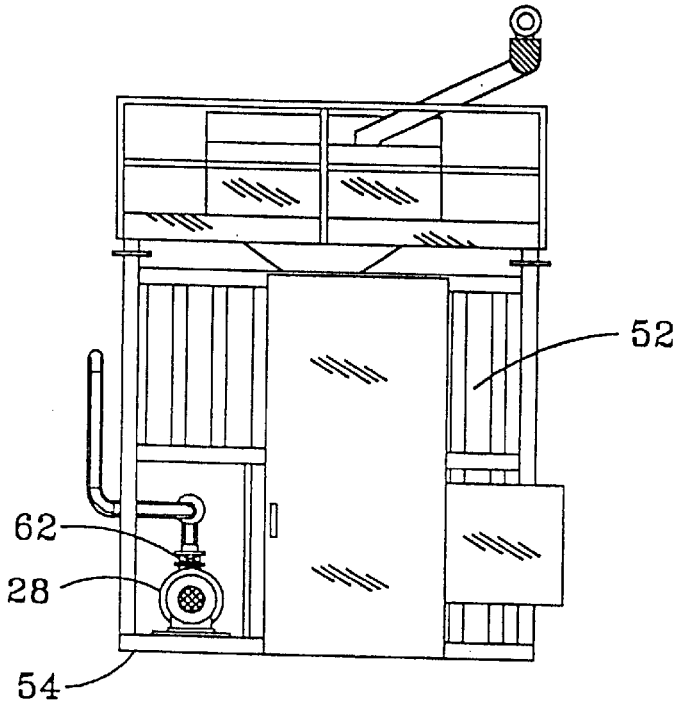
FIG. 8 is a right side view of the embodiment illustrated in FIG. 6.
Figure 9:
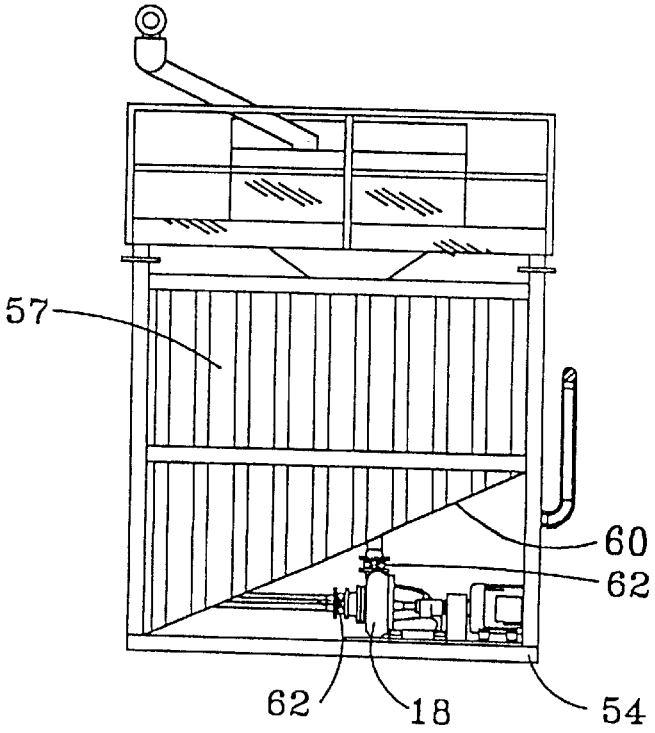
FIG. 9 is a left side view of the embodiment illustrated in FIG. 6 taken along sight line 9—9.
Figure 11:
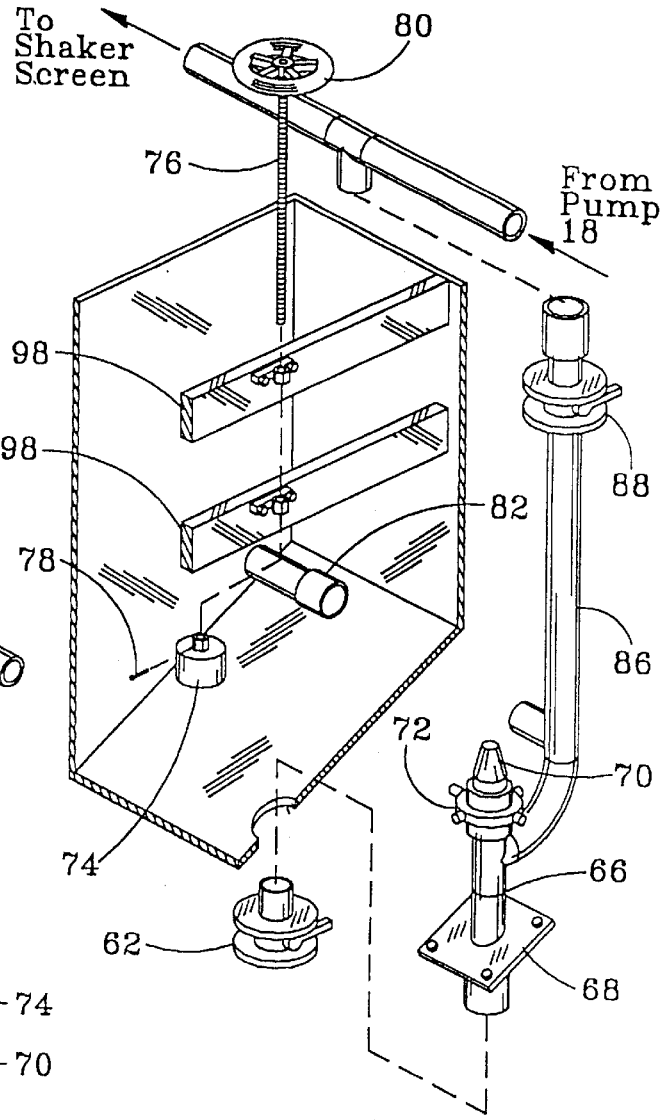
FIG. 11 is a partial exploded view of the arrangement shown in FIG. 10.
Figure 10:
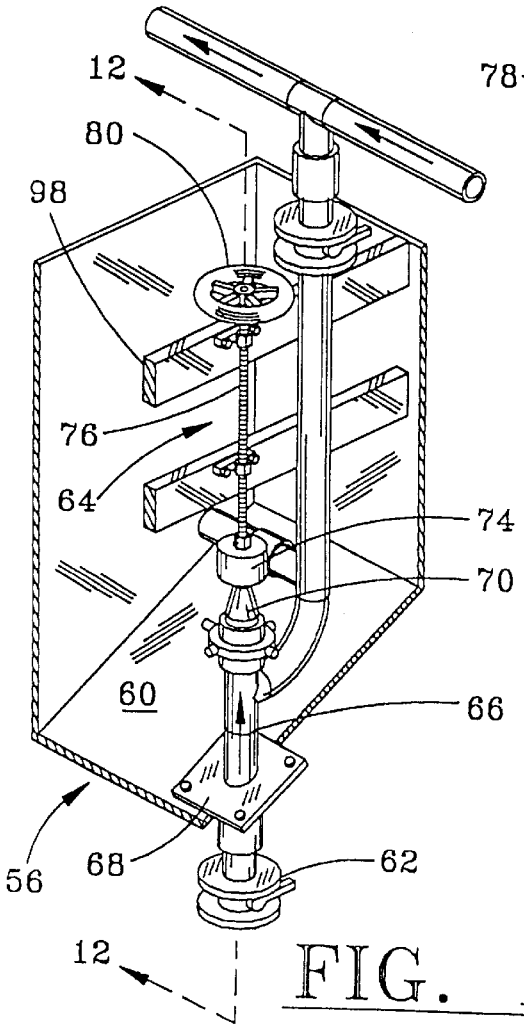
FIG. 10 is a partial section view of the embodiment illustrated in FIG. 6 taken along sight lines 10—10.
Figure 12:
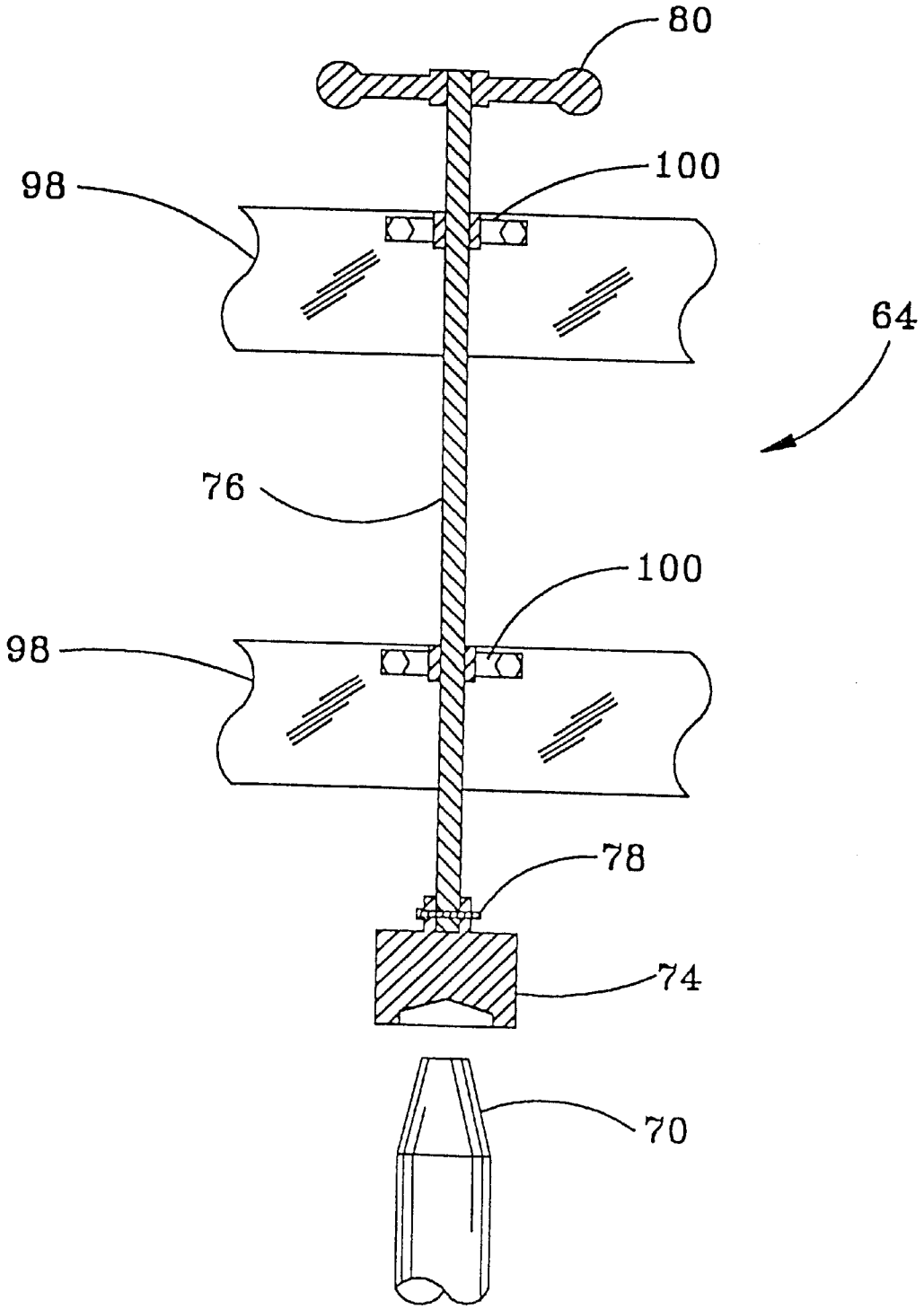
FIG. 12 is a cross section view taken along the sight line 8—8 in FIG. 10.

The second embodiment 50 as illustrated in FIG. 6 perform the essentially the same function as the first embodiment 10. However, this arrangement provides a more compact and efficient unit. For example the holding tank 24 and the two slurry tanks 16 and 22 have been unitized. As seen in FIG. 6 the holding tank 52 occupies one end of the skid 54. A lower portion of the holding tank 52 is removed, as seen in FIG. 8 to provide a space for the super charging and recirculating pump 28. The two slurry tanks 56,57 occupy the remaining portion of the skid 54 adjacent the holding tank 52 separated only by a petition 58. The slurry tanks 56,57 have sloping bottoms 60, as seen in FIG. 9, extending the width of the skid 54. This allows room to mount the grinding pumps 18, 19 below the tanks. This arrangement allow the width and the height of the skid 54 to be kept to a minimum while maintaining maximum capacity. Thereby producing a smaller foot print where space is at a premium. To improve service ability, quick couples 62 are provided on all pump connections thus allowing fast pump clean out and/or replacement. As seen in FIG. 7 the shaker 20 is mounted above the holding and slurry tanks 52,56–57 which allows for easy access and visual inspection of the tank interiors via screen decks 64. Turning now to FIG. 10 we see a somewhat different arrangement of the particle size control apparatus which takes the place of the high pressure impingement system illustrated in FIG. 4 of the first embodiment 10. This embodiment 50 utilizes the grinder pumps 18 and 19 to direct the slurry 16 upwards through a stand pipe 66 which is removable by disconnecting the deck plate 68 and uncoupling the quick couple 62 the stand pipe is coupled to a replaceable nozzle 70 via a pipe union 72. The slurry 16 is then directed towards a replaceable impingement member 74 having a conical portion therein which is in turn connected via threaded rod 76 and pin 78. The impingement member may therefore be adjustably lowered into close proximity with the nozzle 70 by simply turning the hand wheel 80 connected to the threaded rod 76, thus adjusting the particle size of the slurry 16. As seen in FIG. 11 this arrangement not only allows the slurry 15 particle size to be adjusted from the top of the tanks 56,57 but also allows quick removal for cleaning or replacement of the stand pipes 66, nozzle 70 and impingement member 74 from the top of the tanks 56,57. As seen in FIG. 12 the threaded rod 76 is supported by removable, threaded nut, assemblies 100 mounted to frame members 98.

It should also be noted that by having the slurry tanks 56,57 located adjacent the holding tank 52 separated only by a common partition which is slightly below the level of the surrounding walls thereby allowing the slurry 16 in the holding tank to overflow into the slurry tanks 56,57 if necessary.

As seen in FIG. 6 piping 82 leading from the outlet of the super charging pump 28 may be directed via a valve 84 to the stand pipe 66 located in the first slurry tank 56, thereby further reducing the particle size of the slurry in the holding tank. Piping 86 is also provided in each of the slurry tanks as seen in FIG. 11 which directs flow of the slurry from the grinding pumps 18,19 back to the vibrator screen 20 via valve 88 where the cuttings were first delivered via a transfer system 14 for separation. The shaker or vibrator screen 20 delivers all fluids and particles of a predetermined size passing through the screen as underflow directly to the holding tank, while the oversize cuttings materials are discharged as overflow into the cuttings slurry tanks 56,57 for processing by the grinding pumps 18,19 and the particle quality assurance system controlled by the impingement and recirculating system discussed above.

Figure 13:
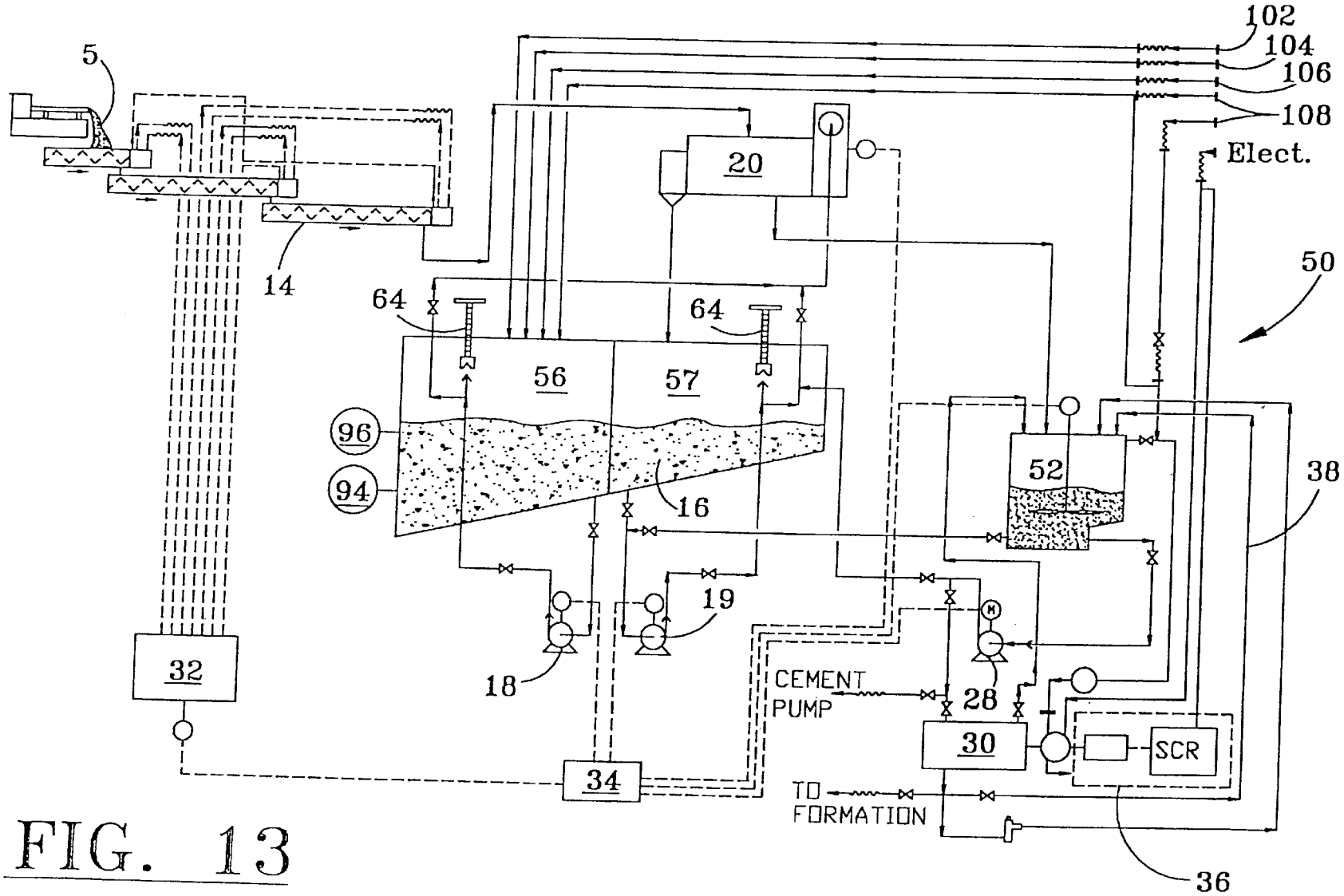
FIG. 13 is schematic diagram of the process system of the second embodiment illustrated in FIGS. 6–9.

As seen in FIG. 13 the second embodiment further includes both temperature sensors 96 and viscosity and density sensors 94 located in each of the slurry tanks and controllers for same. It is also anticipated that chemicals used for controlling the viscosity of the slurry 16 may be piped via line 102 into each of the slurry tanks 56,57 as well as waste water 104 and sea water 106 or fresh water to control the density.

Figure 14:
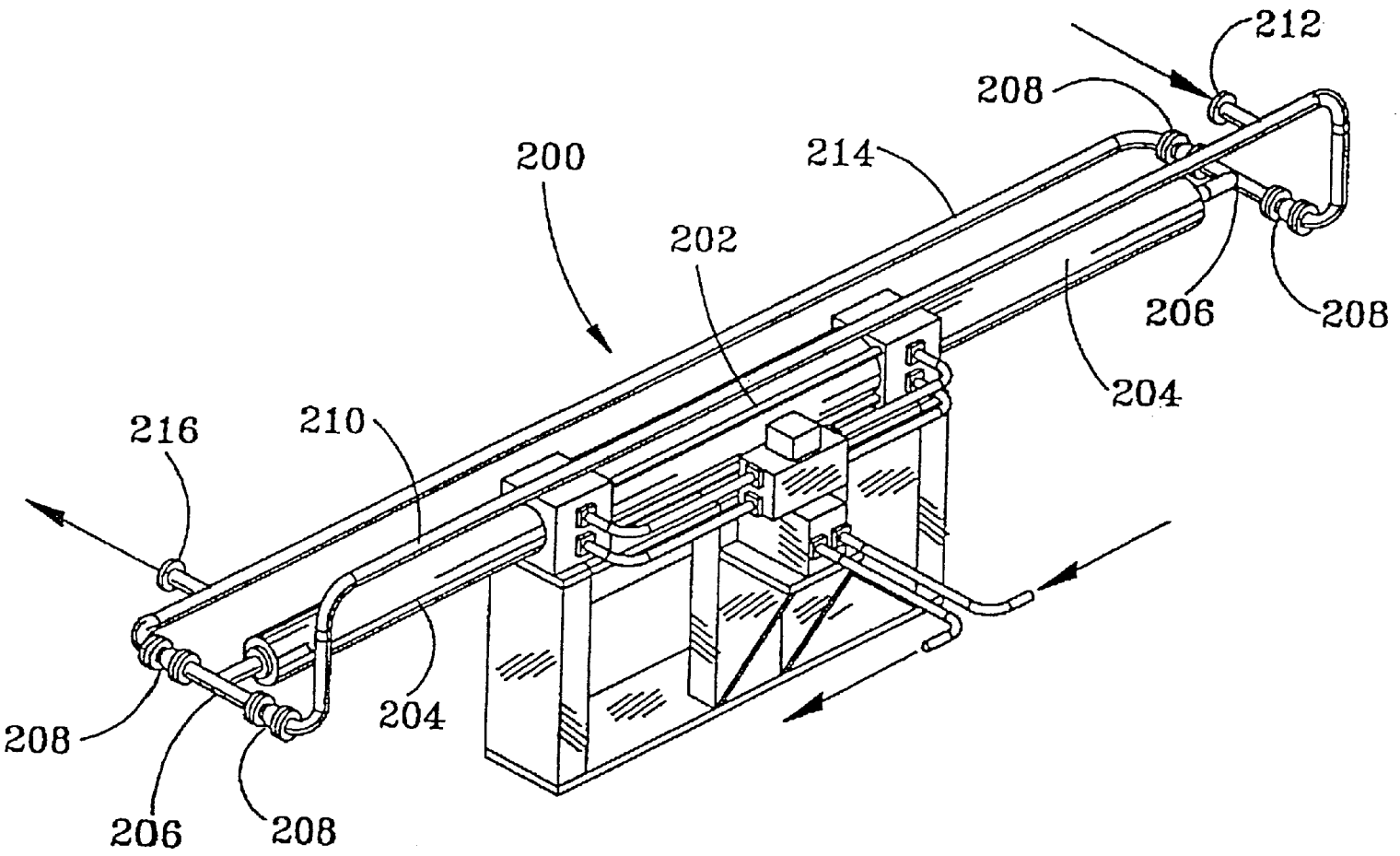
FIG. 14 is an isometric view of an alternative injection pump.

As previously explained herein the injection pump 30 may be replaced by a piston or cylinder intensifier pump such as that illustrated in FIG. 14. This type of pump 200 utilizes a double acting hydraulic cylinder assembly 202 having dual rods one extending from each end of the piston thereby forming a double rod cylinder. Each rod is then enclosed or encased in a product cylinder 204 having inside diameter slightly larger than the rod diameter. Thereby intensifying the force of the cylinder rod by the difference between the hydraulic cylinder piston displacement and rod displacement multiplied by the hydraulic pressure. Each product cylinder 204 is fitted with a pipe tee fitting 206 at one end whereby a check valve 208 is attached to the each of the two remaining ends. An inlet manifold line 210 is connected to one of the check valves 208 at each product cylinder 204 in a manner whereby the manifold line 210 is also connectable via a quick coupling 212 to the drill cuttings tank. An outlet manifold line 214 is also connected to the remaining check valve 208 at each product cylinder 204 in a manner whereby the manifold line 214 is also connectable via quick coupling 216 to the well head injection line. The hydraulic cylinder 202 is connected to a hydraulic power unit and valve system having electric sensors and controls which alternately stroke the cylinder 202. The linear configuration of the pump unit 200 allows the unit to fit snugly within the confines of the skid package of the units 12 and 50 discussed herein.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A modular processing and injection system for the injection of drill cuttings, in an earth formation comprising:

a) a means for receiving drill cuttings;

b) a slurry system connected to said means for receiving drill cuttings said slurry system further including a means for producing a drill cuttings slurry and circulating said slurry throughout said processing and injection system;

c) a means for reducing particle size of said drill cuttings entrained within said slurry;

d) an injection pump means attached to said processing system, for injecting said drill cuttings slurry into an earth formation;

e) a drive means for driving said injection pump means;

f) a speed and torque regulation system connected to said drive means; and g) a computer means for electrically controlling said speed and torque regulation, processing, and injection systems.

2. A modular processing and injection system for the injection of drill cuttings, in an earth formation according to claim 1 wherein said means for receiving drill cuttings further includes a collection and conveying system.

3. A modular processing and injection system for the injection of drill cuttings, in an earth formation according to claim 1 wherein said means for reducing particle size of said drill cuttings entrained within said slurry includes a high speed mill.

4. A modular processing and injection system for the injection of drill cuttings, in an earth formation according to claim 1 wherein said means for reducing particle size, of said drill cuttings entrained within said slurry, includes a particle impingement means.

5. A modular processing and injection system for the injection of drill cuttings, in an earth formation according to claim 1 wherein said means for circulating said slurry is a pump having an impeller coated with a tungsten carbide impregnated matrix.

6. A modular processing and injection system for the injection of drill cuttings, in an earth formation according to claim 1 wherein said injection pump is a high pressure triplex type pump.

7. A modular processing and injection system for the injection of drill cuttings, in an earth formation according to claim 1 wherein said computer means includes a program for automating said processing and injection system's functions in response to well formation injection variables.

8. A modular processing and injection system for the injection of drill cuttings, in an earth formation according to claim 1 wherein said speed and torque control regulation system comprises an electronic, programable motor speed controller with torque sensing feed back and horse power limiting circuitry.

9. A modular processing and injection system for the injection of drill cuttings, in an earth formation comprising:

a) a drill cutting collection and conveying system connected to a drilling rig's solids control shale shaker system;

b) a slurry system connected to said collecting and conveying system;

c) a means for producing a cuttings slurry within said slurry system and circulating said slurry throughout said processing and injection system;

d) a milling means for reducing particle size of said drill cuttings entrained within said slurry;

e) an injection pump means attached to said processing system, for injecting said drill cuttings slurry into an earth formation;

f) a drive means for driving said injection pump means;

g) a speed and torque regulation system connected to said drive means; and h) a computer means for electrically controlling said speed and torque regulation, processing, and injection systems.

10. A modular processing and injection system for the injection of drill cuttings, in an earth formation comprising:

a) a drill cutting collection and conveying system connected to a drilling rig's solids control shale shaker system;

b) a slurry system connected to said collecting and conveying system;

c) a means for producing a cuttings slurry within said slurry system and circulating said slurry throughout said processing and injection system;

d) a milling means for reducing particle size of said drill cuttings entrained within said slurry;

e) a means of impinging said drill cuttings entrained within said slurry for further reducing said particle size;

f) an injection pump means attached to said processing system, for reinjecting said drill cuttings slurry into an earth formation;

g) a drive means for driving said injection pump means;

h) a speed and torque regulation system connected to said drive means; and i) a computer means for electrically controlling said speed and torque regulation, processing, and injection systems.

11. A modular processing and injection system for the injection of drill cuttings, in an earth formation according to claim 10 wherein said means of impinging comprised a high pressure slurry line connected to said injection pump terminating inside a tank, said high pressure line having at least one nozzle inside said tank directed towards an impingement plate.

12. A modular processing and injection system for the injection of drill cuttings, in an earth formation according to claim 10 wherein said milling means is a roll mill.

13. A method of processing and injecting drill cuttings into an earth formation comprising the steps of:

a) premixing chemical gels in a drill cuttings slurry for controlling yield strength and fluid loss over long periods;

b) providing an automated means for introducing said gels into said slurry; and c) programming said automated means to introduce said gels into said slurry at a predetermined rate based on formation requirements when injecting drill cuttings into a well while drilling said well.

14. An oil and gas well, drill cuttings, processing and injection system comprising:

a) a conveying means for collecting and delivering cuttings via fluid recovery shale shakers to said processing and injection system;

b) at least one slurry tank connected to said conveying means;

c) a means located within said slurry tank for mixing a fluid with said cuttings to produce a slurry;

d) a means for circulating said slurry;

e) a system shale shaker fludically connected to said means for circulating said slurry;

f) a means for grinding cuttings particles entrained in said slurry and discharging said slurry into slurry tank;

g) a holding tank fluidically connected to said system shale shaker, said means for circulating and said second slurry tank;

h) a pump means for circulating said slurry from said system shale shaker fludically connected to said holding tank and said second slurry tank;

i) an injection pump means fludically connected to said first and second slurry tanks and said holding tank for injecting processed cuttings in said slurry into an earth formation;

j) an electrical drive means for driving said injection pump means;

k) a means for controlling speed and torque of said electrical drive means; and l) a fragmentation means comprising a plurality of nozzles attached to an inflow line from said injection pump discharge, said nozzles being further directed towards a metal surface plate located inside said holding tank for fragmenting entrained particles in said slurry.

15. An oil and gas well, drill cuttings process and injection system according to claim 14 wherein said drive means is an electric motor having electric speed control regulation with torque and horsepower limiting capability.

16. An oil and gas well, drill cuttings process and injection system according to claim 14 wherein said electrical control means for controlling speed and torque of said electrical drive means are contained in housings which meet electrical safety regulations for class 1 zone 1 hazardous locations.

17. An oil and gas well, drill cuttings process and injection module according to claim 14 wherein said injection pump means is a high pressure triplex pump.

18. An oil and gas well, drill cuttings process and injection system according to claim 14 wherein said electrical drive means is an electric motor having between 200–1000 horsepower.

19. A method of processing and injecting drill cuttings into an earth formation adjacent a well casing while drilling comprising the steps of:

a) collecting drill cuttings from shale shakers associated with a drilling mud recovery system;

b) processing said drill cuttings by passing said cuttings through an injection module comprising;

i) a conveying means for delivering said drill cuttings to said injection module;

ii) a first slurry tank connected to said conveying means;

iii) a second slurry tank connected to said first slurry tank;

iv) a means located within said first and second slurry tanks for mixing a fluid with said cuttings to produce a slurry;

v) a means for circulating said slurry between said first and second slurry tanks;

vi) a system shaker screen connected to said means for circulating said slurry;

vii) a means for high speed grinding and discharging entrained cuttings into said first and second slurry tanks;

viii) a holding tank fluidically connected to said shaker screen, said means for circulating and said second slurry tank;

ix) a means for circulating said slurry from said shaker screen connected to said holding tank and said second slurry tank;

x) an injection pump means fludically connected to said first and second slurry tanks and said holding tank for injecting said slurry into an earth formation;

xi) an electrical drive means for driving said injection pump means;

xii) a means for controlling speed of said electrical drive means; and xiii) a fragmentation means located inside said holding tank for fragmenting entrained particles in said slurry;

c) controlling quality of said slurry by fragmenting entrained particles in said slurry;

d) injecting said drill cuttings into an earth formation;

e) controlling speed, and torque of said injection pump, electrically; and f) impinging said entrained particles, at high pressure, against a set of plates.

20. A method of processing and injecting drill according to claim 19 wherein said means for controlling said electrical drive means includes electronically sensing torque requirements and varying the drive speed to compensate and maintain a preselected pressure on said cuttings slurry during injection.

21. A method of processing and injecting drill cuttings into an earth formation comprising the steps of:

a) automating a drill cuttings processing and injection system; and b) programming said automated processing and injection systems to control the injection of drill cuttings and cutting slurry in the earth formation surrounding a well while drilling said well based on progressive changes in injection system pressure, cuttings density and calculated formation volume capacity.

22. A method for processing drill cuttings for injection into an earth formation comprising the steps of:

a) collecting said drill cuttings;

b) producing a slurry by adding fluid to said drill cuttings;

c) sizing by milling said drill cutting slurry;

d) homogenizing by mixing and circulating said slurry until all solid particles are entrained in solution; and e) fragmenting said entrained solid particles by impinging said solid particles at high pressure, against a surface.

23. A method for processing drill cuttings for injection into an formation according to claim 22 wherein said fragmenting of entrained solid particle reduces said solid particle size to less than 100 micron.

24. A method of processing and injecting drill cuttings into a well formation while drilling comprising the steps of:

a) automating a drill cuttings processing and injection system; and b) programming said processing and injection system to control cuttings injection into a well formation while drilling said programming being responsive to automated data input based on real time down-hole earth formation data.

25. A method of processing and injecting drill cuttings into an earth formation comprising the steps of: and a) automating a drill cuttings processing and injection system;

b) programming said automated processing and injection systems based on progressive changes in injection system pressure, cuttings density and calculated formation volume capacity.

26. A method of injecting oil and gas well drill cuttings into an earth formation comprising;

a) providing a drill cuttings injection pump;

b) providing an electrical means for driving said injection pump; and c) providing a means for electrically controlling speed and horsepower input to said injection pump; and d) programming said means for electrically controlling speed and horsepower to compensate for variable conditions encountered while injecting drill cuttings in a well while drilling said well based on real time data input from a well logging system.

27. A modular cuttings injection system according to claim 26 wherein said injection pump is a ram injection unit comprising;

a) a hydraulic cylinder having a rod end at each end of said cylinder;

b) a product cylinder connected to each said rod end;

c) a pipe tee fitting connected to one end of said product cylinder, opposite said hydraulic cylinder;

d) an inlet check valve and an outlet check valve connected to said tee;

e) a first manifold having an outlet port connected to each said outlet check valve;

f) a second manifold having an inlet port connected to each said inlet check valve; and g) a means for automatically alternately stroking said hydraulic cylinder.

28. A modular cuttings injection system according to claim 26 wherein said grinding and circulating pumps are connected to inlet and out conduits via quick couplings.

29. A modular cutting injection system according to claim 26 wherein said injection system further comprises a system for monitoring and controlling viscosity and density of said drill cuttings.

30. A modular cuttings injection system according to claim 26 wherein said holding tank and said slurry tanks form a single modular unit.

31. A modular cuttings injection system according to claim 26 wherein said drill cuttings slurry in said holding tank is allowed to overflow into said slurry tank.

32. A modular cuttings injection system according to claim 26 wherein said slurry tanks have sloping bottoms.

33. A modular cuttings injection system according to claim 26 wherein said stand pipe is replaceable from the top of said slurry tank.

34. A modular cuttings injection system according to claim 26 wherein said nozzle is replaceable from the top said slurry tank.

35. A modular cuttings injection system according to claim 26 wherein said impingement member further comprises a conical impingement surface and is adjustable relative said nozzle via a hand wheel.

36. A modular cuttings injection system according to claim 26 wherein said system for monitoring and controlling viscosity and density of said drill cuttings includes the use of chemicals, waste and sea water.

* * * * *